US012325987B2

(12) United States Patent
Kim et al.

(10) Patent No.: US 12,325,987 B2
(45) Date of Patent: Jun. 10, 2025

(54) ELECTRONIC FAUCET WITH AUTO FOCUS

(71) Applicant: ASSA ABLOY Americas Residential Inc., New Haven, CT (US)

(72) Inventors: Andy Ejung Kim, Lake Forest, CA (US); Adam William Tracy, Irvine, CA (US); Kevin Pasma, Lake Forest, CA (US)

(73) Assignee: ASSA ABLOY Americas Residential Inc., New Haven, CT (US)

( * ) Notice: Subject to any disclaimer, the term of this patent is extended or adjusted under 35 U.S.C. 154(b) by 58 days.

(21) Appl. No.: 17/714,256

(22) Filed: Apr. 6, 2022

(65) Prior Publication Data

US 2022/0325508 A1 Oct. 13, 2022

Related U.S. Application Data

(60) Provisional application No. 63/171,867, filed on Apr. 7, 2021.

(51) Int. Cl.
*E03C 1/05* (2006.01)
*E03C 1/04* (2006.01)

(52) U.S. Cl.
CPC ..... *E03C 1/057* (2013.01); *E03C 1/0405* (2013.01)

(58) Field of Classification Search
CPC ..... E03C 1/057; E03C 1/0405; E03C 1/0404
USPC ..... 137/801, 883
See application file for complete search history.

(56) References Cited

U.S. PATENT DOCUMENTS

| | | | | |
|---|---|---|---|---|
| 8,162,236 | B2 * | 4/2012 | Rodenbeck | E03C 1/057 239/447 |
| 10,060,540 | B2 * | 8/2018 | Cutler | F16K 11/044 |
| 10,385,555 | B2 * | 8/2019 | Braddock | E03C 1/057 |
| 11,512,457 | B2 * | 11/2022 | Taki | G01V 8/10 |
| 2009/0113619 | A1 * | 5/2009 | Tichenor | E03C 1/08 4/619 |
| 2020/0122176 | A1 * | 4/2020 | Floyd | G05B 13/027 |
| 2022/0108572 | A1 | 4/2022 | Lovett | |

FOREIGN PATENT DOCUMENTS

WO 2021/231458 11/2021

* cited by examiner

*Primary Examiner* — Janie M Loeppke
(74) *Attorney, Agent, or Firm* — Merchant & Gould P.C.

(57) ABSTRACT

A faucet includes a faucet spout, a sensor assembly, a spray pattern controller, and a controller. The faucet body includes a faucet spout. The sensor assembly is configured to detect an object within a space proximate the faucet spout. The spray pattern controller is configured to adjust a spray pattern selected from a plurality of spray patterns being dispensed through the faucet spout. The controller is electronically coupled to the sensor assembly and the spray pattern controller, the controller capable of determining a desired spray pattern from the plurality of spray patterns.

24 Claims, 14 Drawing Sheets

ELECTRONIC FAUCET WITH AUTO FOCUS

CROSS-REFERENCE TO RELATED APPLICATIONS

This application claims priority to and the benefit of U.S. Provisional Patent No. 63/171,867, filed Apr. 7, 2021, the disclosure of which is hereby incorporated by reference herein in its entirety.

TECHNICAL FIELD

The present disclosure relates generally to faucets. In particular, the present disclosure relates to a faucet that automatically changes spray patterns.

BACKGROUND

Kitchen faucets generally include a mechanical means for adjusting a spray pattern of the water. The spray head may include a button that allows a user to press to change the spray pattern being dispensed. Faucets with multiple spray patterns typically comprise mechanical parts to control the temperature and flow of water. In many situations, a mechanical switch controls the water flow through one or more spray head designs. Typically, a user manipulates the mechanical button to adjust the spray pattern.

Further, some faucets include features that allow for hands-free use. Faucets without a handle may be controlled by sensors or other means, such as voice controlled. Faucets with the sensor include the ability to sense motion, which is used to turn the faucet on or off. Generally, these faucets only sense movement to control the water flow rate, for example, turning the water on or turning the water off.

SUMMARY

According to the present disclosure, a faucet as described includes a sensor assembly comprising at least one optical sensor that is configured to detect an object within a space proximate the faucet spout.

According to a first aspect, a faucet includes a faucet spout, a sensor assembly, a spray pattern controller, and a controller. The faucet body includes a faucet spout. The sensor assembly is configured to detect an object within a space proximate the faucet spout. The spray pattern controller is configured to adjust a spray pattern selected from a plurality of spray patterns being dispensed through the faucet spout. The controller is electronically coupled to the sensor assembly and the spray pattern controller, the controller capable of determining a desired spray pattern selected from the plurality of spray patterns.

In another aspect, a method of controlling a spray pattern dispensed from a faucet is described. The method includes detecting, via a sensor assembly comprising at least one sensor, an object located in a space proximate to a faucet spout; sending a signal from the sensor assembly to a controller, the controller electronically coupled to the sensor assembly and a spray pattern controller, wherein the controller is configured to determine a desired spray pattern selected from a plurality of spray patterns; sending a second signal from the controller to the spray pattern controller; and adjusting the spray pattern through a faucet, the spray pattern controlled by the spray pattern controller.

In yet another aspect, an electronic spray pattern control device is described. The electronic spray pattern controller includes an electronic spray pattern control assembly, a sensor assembly, and a controller. The electronic spray pattern control assembly comprises a fluid inlet and a fluid outlet, and is configured to control a water spray pattern being dispensed through a faucet spout. The sensor assembly comprises at least one sensor configured to detect an object within a space proximate the faucet spout. The controller is electronically coupled to the sensor assembly and the electronic spray pattern assembly, the controller is configured to receive the object from the sensor assembly to adjust the water spray pattern based on the object received.

Additional features of the present disclosure will become apparent to those skilled in the art upon consideration of illustrative embodiments including the best mode of carrying out the disclosure as presently perceived.

BRIEF DESCRIPTION OF THE FIGURES

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
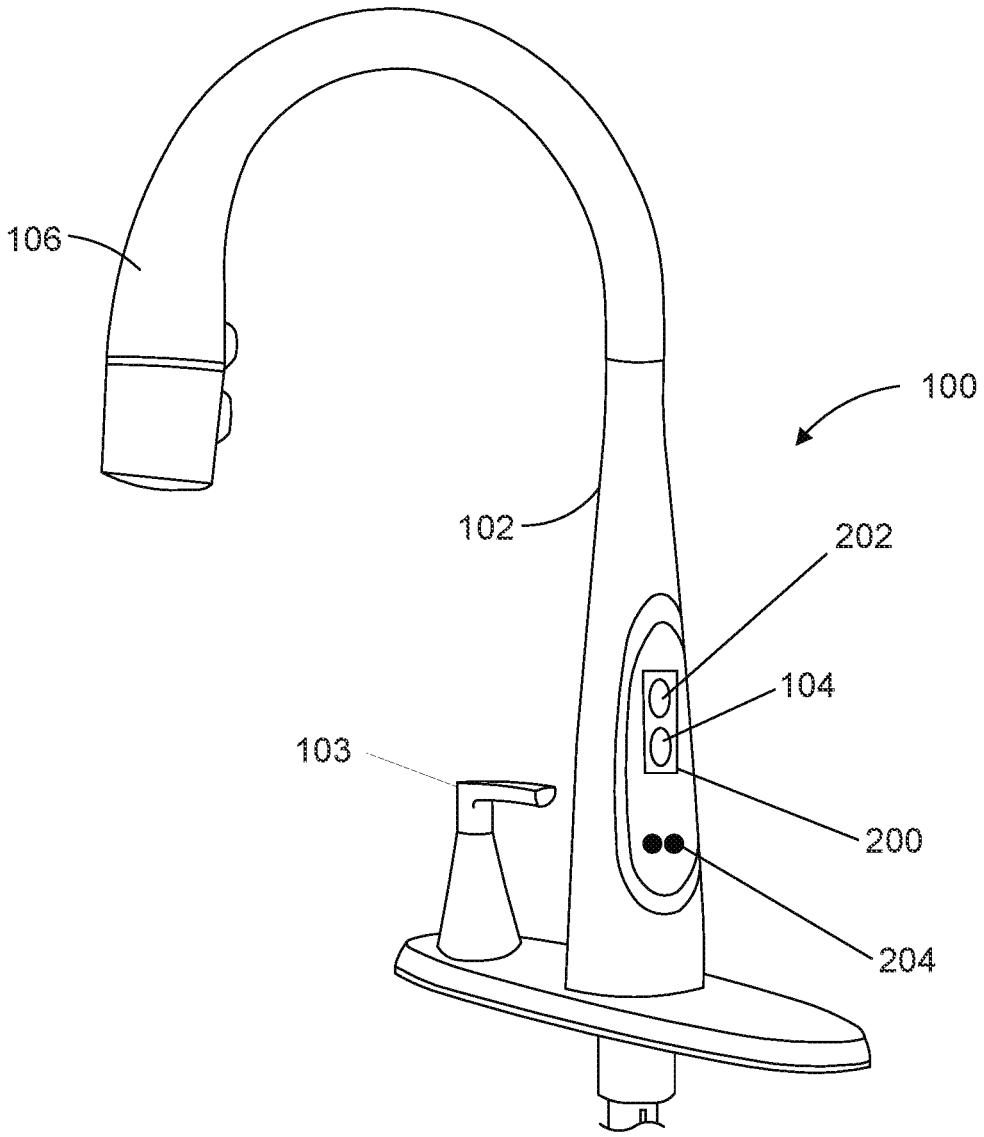
FIG. 1 illustrates a perspective view of an example faucet according to an embodiment of the disclosure.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

A faucet having multiple spray patterns is better suited to provide for different activities. For example, rinsing a toothbrush requires a more powerful stream with a focused area, whereas handwashing requires a softer spray covering a wider area. The faucet as described herein electronically senses an object underneath the spray area and automatically adjusts the spray pattern. A first spray pattern may be a more powerful spray pattern that covers a smaller area, and a second spray pattern may be a softer spray pattern that covers a wider area. Further, the faucet described herein can automatically adjust a spray pattern without manual adjustment from the user.

In general, and as discussed herein, the plurality of spray patterns described herein may provide advantageous performance regarding a particular set of applications, including those which may be encountered in a bathroom environment. Accordingly, in some examples described herein, different flow patterns may be provided by different outlets which are selected by a spray pattern controller when the sensor senses an object. In other examples, a diverter is located within the faucet body to direct a flow of water through a single outlet in the faucet spout. The different flow patterns may be, for example, different in pressure, different in spray pattern, different in cross-sectional area covered, different in direction, or some combination thereof. In other examples, the different flow patterns are provided through a single outlet, which is controlled by a diverter without an aerator head. The faucet provides a means for automatically switching between spray patterns based on a detected object.

FIG. 1 is a perspective view of an example faucet 100 according to an embodiment of the disclosure. In the example shown, the faucet 100 includes a faucet body 102, a faucet spout 106, a user interface 104, and a handle 103 that can manually control the water flow through the faucet spout 106 based on user-actuated movement. Although this disclosure will be discussed with regard to a bathroom faucet for purposes of example, the control system described herein could be implemented in any type of faucet, including kitchen faucets, whether the faucet has a single handle, multiple handles, or no handle. Still further, the control system may be integrated into an existing faucet, including kitchen faucets and bathroom faucets with a mechanical handle.

In some embodiments, like the example shown in FIG. 1, the faucet 100 includes a handle 103, which can be used to manually control a water flow in conjunction with detecting an object to determine a flow pattern. However, in other embodiments, a handle 103 may not exist and other means of using the faucet are contemplated, for example, detecting hand gestures or being voice-controlled. The handle 103 extends from a faucet body 102, and is interfaced to a cartridge (not shown) within the faucet 100 to control the flow of water through a water passageway within the faucet spout 106.

The faucet spout 106 extends from and is integral to the faucet body 102. In the embodiment as shown, the faucet 100 does not include a moveable outlet portion. The faucet body 102 and faucet spout 106 are a rigid unitary body. However, in alternative embodiments, the faucet spout 106 may be removable from the faucet body 102.

Detecting an object in the context of the present disclosure, can include detecting a variety of shapes and sizes in proximity to the faucet spout 106. An object may be detected through the use of sensors or cameras. For example, a toothbrush may be detected, which, in one embodiment, is classified as a small object. In another example, a pair of hands is detected, which is classified as a large object. In this example, a small object is associated with a first spray pattern and a large object is associated with a second spray pattern. As discussed herein, the objects are associated with a desired flow pattern dispensed by the faucet 100. The spray pattern may include a combination of pressures and cross-sectional area covered.

In an alternative embodiment, detecting an object can include detecting a type of material of the object or a motion of the object. For example, a razor may be detected, which is classified as an inorganic material, and a first spray pattern is dispensed. In another example, a pair of hands is detected, which is classified as an organic material, and a second spray pattern is dispensed. Still further, when a razor is detected, it is not moving, and a first spray pattern is dispensed, while when a pair of hands is detected, which are moving, a second spray pattern is dispensed.

In yet another embodiment, detecting an object can include detecting a temperature of the object via at least one infrared sensor. For example, a razor may be detected, which is classified as a cold material, and a first spray pattern is dispensed. In another example, a pair of hands is detected, which is classified as a warm material, and a second spray pattern is dispensed.

In yet another embodiment, detecting an object includes recognizing objects with a computing system. The computing system includes an edge processing unit having an artificial intelligence (AI) system or machine-learning algorithm. An edge processing unit can be trained to recognize a subset of images and perform tasks based on a camera view. The objects are recognized and a desired flow pattern is dispensed. In an example, the edge processing unit identifies a pot, and a stream of water is dispensed. The edge processing unit is capable of discerning between a false trigger (such as a vibration of the faucet or detecting a highly reflective surface) and a real object identification.

The faucet body 102, as shown in an example embodiment, extends upwards from a deck, curves, and extends to face back toward the deck. However, the faucet body 102 can be shaped differently to provide a different connection with a faucet handle 103 or faucet spout 106. In the embodiment shown, the user interface 104 is integrated into the faucet body 102 to provide a streamlined appearance. The user interface 104 may be located on a front of the faucet body 102, facing a location proximate the faucet spout 106. In another embodiment, the user interface 104 does not need to be connected directly to the faucet body 102, but could be remote from the faucet body 102, such as located on a sink deck.

The user interface 104 includes a sensor assembly 200, and optionally, a status indicator 204, such as a light source. The sensor assembly 200 includes at least one sensor 202 that is configured to detect objects, and more specifically the size of an object, the material of the object, the motion of the object, or the temperature of the object, which is described in more detail below. In an alternative embodiment, the sensor assembly 200 includes at least one camera.

In an example embodiment, the user interface 104 includes a status indicator 204. The status indicator 204 may include an LED light that illuminates to communicate messages to a user. Numerous icons may be illuminated on the status indicator 204. In some embodiments (e.g., when the sensor assembly 200 detects an object), an LED may be illuminated on the user interface 104 and light may show through the faucet body 102 (e.g., in the shape of an icon), like a one-way screen. For example, a single water droplet icon may be displayed for a slow flow of water, while multiple water droplets indicate a fast flow of water.

Figure 2:
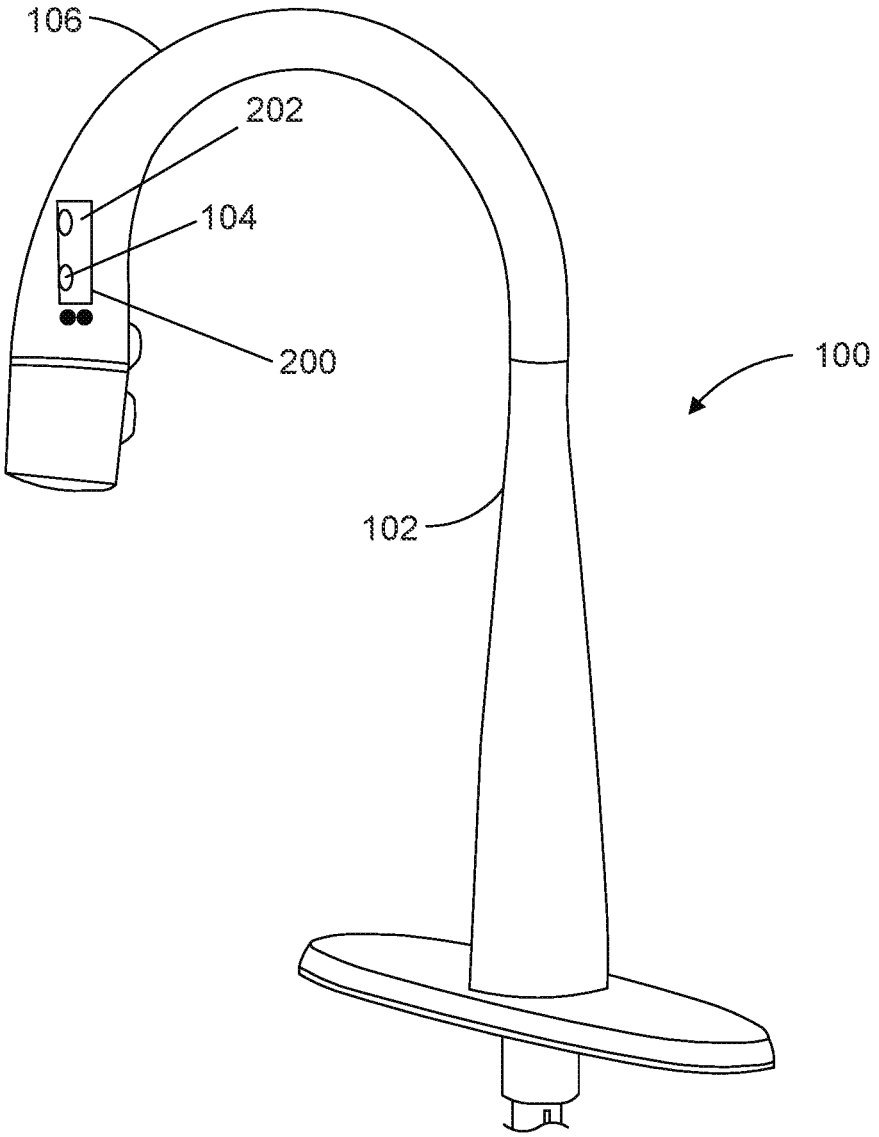
FIG. 2 illustrates a perspective view of an example faucet according to another embodiment of the disclosure.
Figure 3:
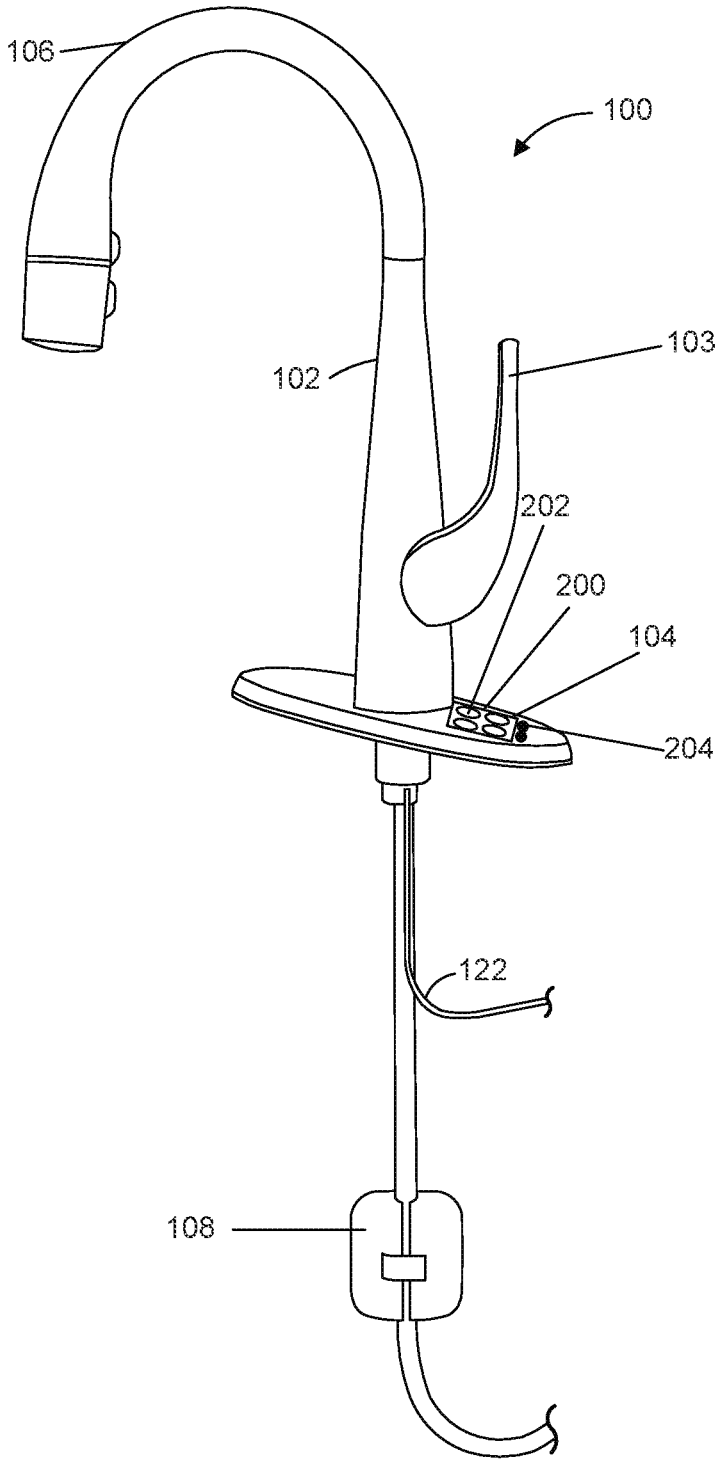
FIG. 3 illustrates a perspective view of an example faucet according to another embodiment of the disclosure.

FIG. 2 is another perspective view of a faucet 100 according to an alternative embodiment of the disclosure. In the example shown, the faucet 100 includes a faucet body 102, and a faucet spout 106 that can be detached or undocked from the faucet body 102. The user interface 104 may be substantially or fully integrated on a faucet spout 106, as shown, or alternatively, the user interface 104 may be mounted on a sink deck (as shown in FIG. 3). A sensor assembly 200 includes at least one sensor 202 that detects an object proximate to the faucet spout 106, such as a toothbrush, and sends signals to a controller (not shown) to control a spray pattern using a spray pattern controller (not shown), for example, through signal wires (not shown). The user interface 104 may be coupled to the signal wire (not shown) that in turn may be coupled to the controller (not shown) or other control circuitry.

In an example embodiment, the spray pattern controller (not shown) is configured to control water flow through a first outlet or a second outlet in the faucet spout 106. In a first embodiment, the spray pattern controller is located at an end of the faucet spout 106, while in another embodiment, the spray pattern controller is located at a different position along the faucet spout 106. In such an arrangement, the spray pattern controller may route water flow along two different paths, leading to the first outlet or the second outlet. In such an arrangement, one or both of the check valve (described below) or push seal (described below) may not be required to be included in the faucet 100.

In another embodiment, the spray pattern controller (not shown) includes a diverter located within the faucet spout 106 that diverts water within an aerator head. The diverter can control the desired spray pattern dispensed. Example spray pattern controllers are described in U.S. Provisional Patent Application No. 63/025,386, filed May 15, 2020, titled "Faucet Having a Plurality of Spray Patterns," and now published as WO 2021/231458 on Nov. 18, 2021, which is herein incorporated by reference in its entirety.

In an alternative embodiment, the faucet 100 does not include a handle 103. In such an embodiment, the faucet 100 is otherwise controlled, for example, via initial detection of an object.

FIG. 3 illustrates another perspective view of a faucet 100. In the example shown, the faucet 100 includes a faucet body 102, a faucet spout 106 that can be detached or undocked from the faucet body 102, and a handle 103 that can manually control the water flow through the faucet body 102 based on user-actuated movement. In an embodiment, the handle 103 can control the flow of water and/or the temperature of the water flowing. In a further embodiment, the handle 103 works in conjunction with the sensor assembly 200. For example, a user may turn on the water flow through the use of the handle 103 and then the spray pattern is automatically determined by the object sensed by the sensor assembly 200.

In the embodiment shown in FIG. 3, the faucet 100 includes a controller 108 located below a sink deck. The user interface 104 may be mounted on the sink deck as shown, or alternatively, the user interface 104 may be substantially or fully integrated into the faucet body 102. As described above, the at least one sensor 202 detects an object and sends signals to the controller 108 to control a spray pattern using a spray pattern controller (not shown), for example, through signal wires 122. The sensor assembly 200 may be coupled to the signal wires 122 that in turn may be coupled to the controller 108 and a spray pattern controller (not shown). The controller 108 can also include a processing unit containing the edge processing unit. As described above, the edge processing unit can comprise an AI module.

A spray pattern controller (not shown) can be located with the faucet spout 106 to provide a desired spray pattern. In an embodiment, the spray pattern controller is capable of providing two different spray patterns. The first spray pattern may have a first pressure and a first flow pattern cross-sectional area. The first spray pattern is useful when washing a small object, such as a toothbrush. The second spray pattern may have a second pressure and a second flow pattern cross-sectional area. The second spray pattern is useful when washing a user's hands. The spray pattern controller can be located elsewhere as appropriate to receive signals from the controller 108 through signal wires 122 and provide a change in the spray pattern from the faucet spout 106.

In a first example, a change in the spray pattern can occur in a discrete manner, where the change from a first spray pattern to a second spray pattern occurs quickly. In a second example, a change in the spray pattern occurs gradually. For example, a gradual change may occur when adjusting in the size of the water exit of the faucet, or a gradual change may occur when water exits a single exit point in the faucet and then water begins to flow from additional exits points in the faucet gradually.

In the example shown, the controller 108 is located below the sink deck. In another embodiment, the controller 108 can be located above the countertop of the faucet 100. The controller 108 could also be located inside the sensor assembly 200.

The connection between the user interface 104, the controller 108, and the spray pattern controller is shown as a wired connection through signal wires 122. In another embodiment, the communication between the sensor assembly 200, the controller 108, and/or the spray pattern controller can be done wirelessly.

Figure 4:
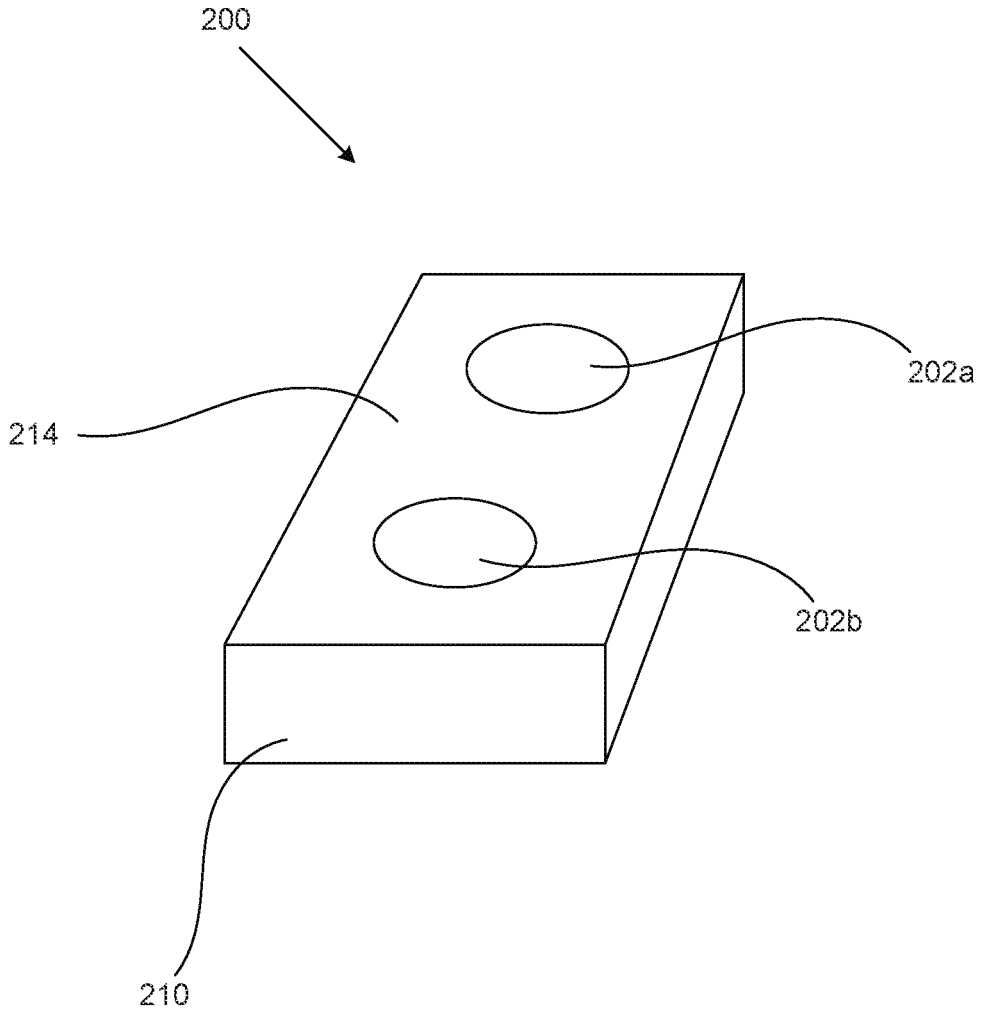
FIG. 4 illustrates an example embodiment of the sensor assembly.

FIG. 4 illustrates an example embodiment of the sensor assembly 200. The sensor assembly 200 includes a housing lid 214, a housing base 210, and at least one sensor 202. In a first embodiment, the at least one sensor 202 is an optical sensor. In another embodiment, the at least one sensor 202 is an infrared sensor. In yet another embodiment, the at least one sensor 202 is a camera.

In the example shown, two sensors 202*a*, 202*b* are present, and each sensor 202*a*, 202*b* is spaced equidistantly from each other. Although the sensor assembly 200 as shown is rectangular, different shaped sensor assemblies 200 may be used. The shape of the sensor assembly 200 may be dependent on where the sensor assembly 200 is located.

The sensor assembly 200 as shown includes a plurality of sensors 202*a*, 202*b*, which are used to detect and differentiate the size of object(s), the motion of the object(s), the material of the object(s) and/or the temperature of the object(s) located proximate the faucet spout 106. In a first embodiment, the optical sensors 202*a*, 202*b* in combination, determine the size of the object. As described herein, the object may be a toothbrush head, which is classified as a small object. However, multiple other objects may be detected and classified as large objects or small objects. In another embodiment, the optical sensors 202*a*, 202*b* in combination, determine a type of material of the object or a motion of the object.

In another embodiment, the optical sensors 202*a*, 202*b* detect a still object, and a first spray pattern is dispensed, while a moving object commands a second spray pattern dispersal. Still further, the sensors 202*a*, 202*b* may be an infrared sensor capable of detecting the temperature of the object in proximity to the faucet spout 106.

In yet another embodiment, the optical sensors 202*a*, 202*b* receives an image of an object and send the image data to the edge processing unit for object identification.

The user interface 104 may be integrated into the faucet body 102 as shown in FIG. 1. However, the user interface 104 may be mounted away from the faucet 100, such as mounted on a faucet base or a sink deck, as shown in FIG. 3. In an embodiment where the user interface 104 is not integrated into the faucet body 102, the user interface 104 may be connected to a controller 108 and spray pattern controller via signal wires 122 or the user interface 104 and circuit may include networking capabilities (e.g., Bluetooth, WiFi, mesh networking, Zigbee, etc.).

Figure 5:
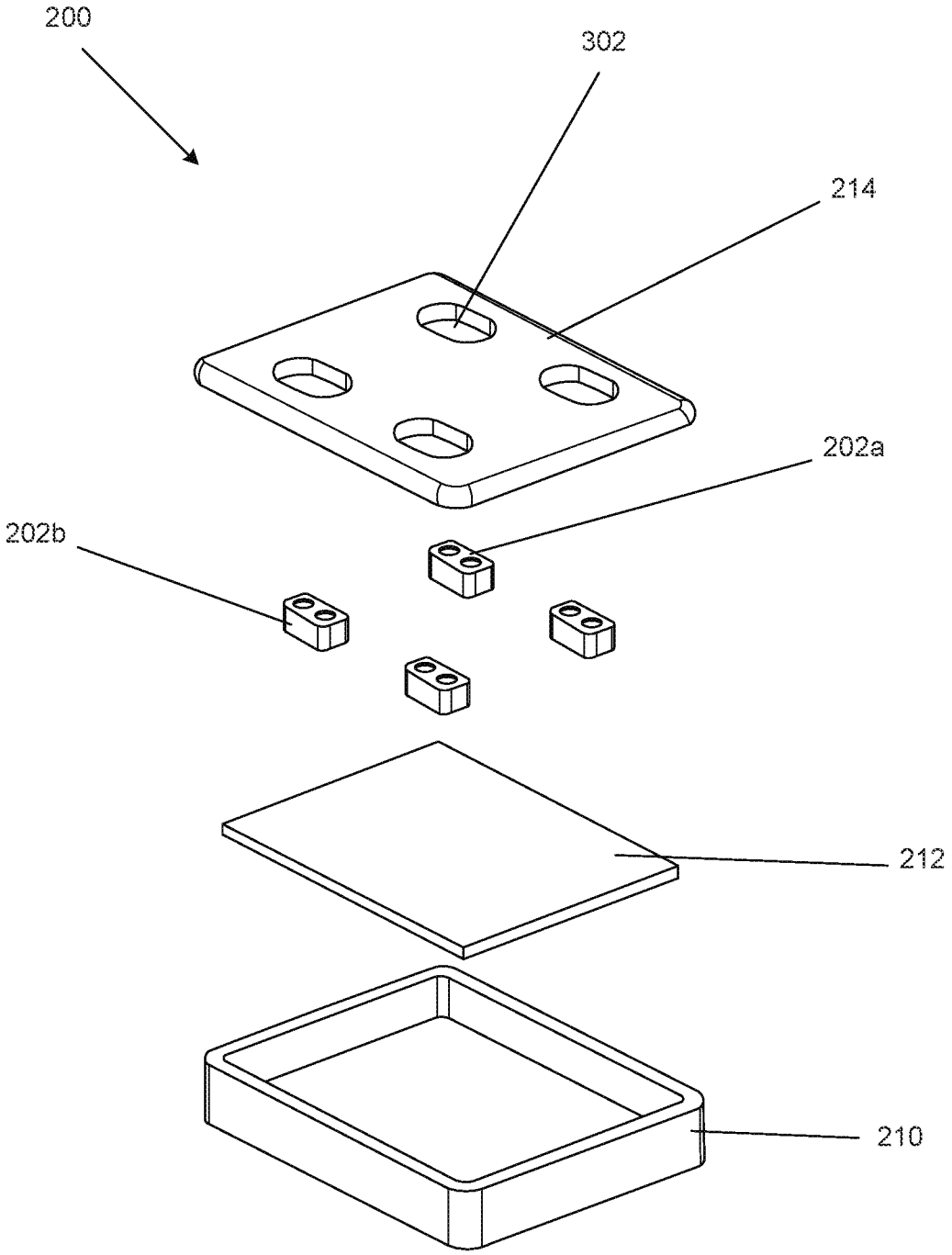
FIG. 5 illustrates an exploded view of the sensor assembly.

FIG. 5 illustrates an exploded view of the sensor assembly 200. The housing lid 214 includes one sensor window 302 for each sensor 202. The sensors 202 are positioned under the housing lid 214 at the sensor window 302. The sensors 202 are in communication with a printed circuit board 212. The sensors 202 and printed circuit board 212 are housed within the housing base 210.

As described above, the sensor assembly 200 is sized and shaped for the location to be placed. In a first example, the sensor assembly 200 is integrated within the faucet body 102 and is designed to match the aesthetics of the faucet 100. In another example, the sensor assembly 200 is integrated within a faucet deck. In yet another example, the sensor assembly 200 is a standalone unit, and is optionally designed to fit within the space.

In an embodiment, machine learning is used to detect one or more objects and determine a desired spray pattern based on the object detected. A computing system (not shown) is associated with the sensor assembly 200 and the controller 108. The computing system is preprogrammed with applicable models to recognize similar objects and movements. The computing system is trained to detect different objects, such as hands, a toothbrush, a razor blade, a makeup brush, and other similar objects. In an embodiment, the computing system may use a model that is continually updated, while in other embodiments, the computing system is unconnected and does not receive model updates. A power source may be located below deck, which is used to power the computing system and/or the sensor assembly 200.

The sensor assembly 200 detects an object and sends the object data via the signal wires 122 to the computing system. The computing system classifies the object data and sends a signal to the spray pattern controller as to which spray pattern is dispense. A sensor assembly is described in more detail at U.S. Provisional Application No. 63/086,649, filed Oct. 2, 2020, titled "Gesture Control Device for a Faucet via Optical Sensors," which is hereby incorporated by reference in its entirety.

Figure 6:
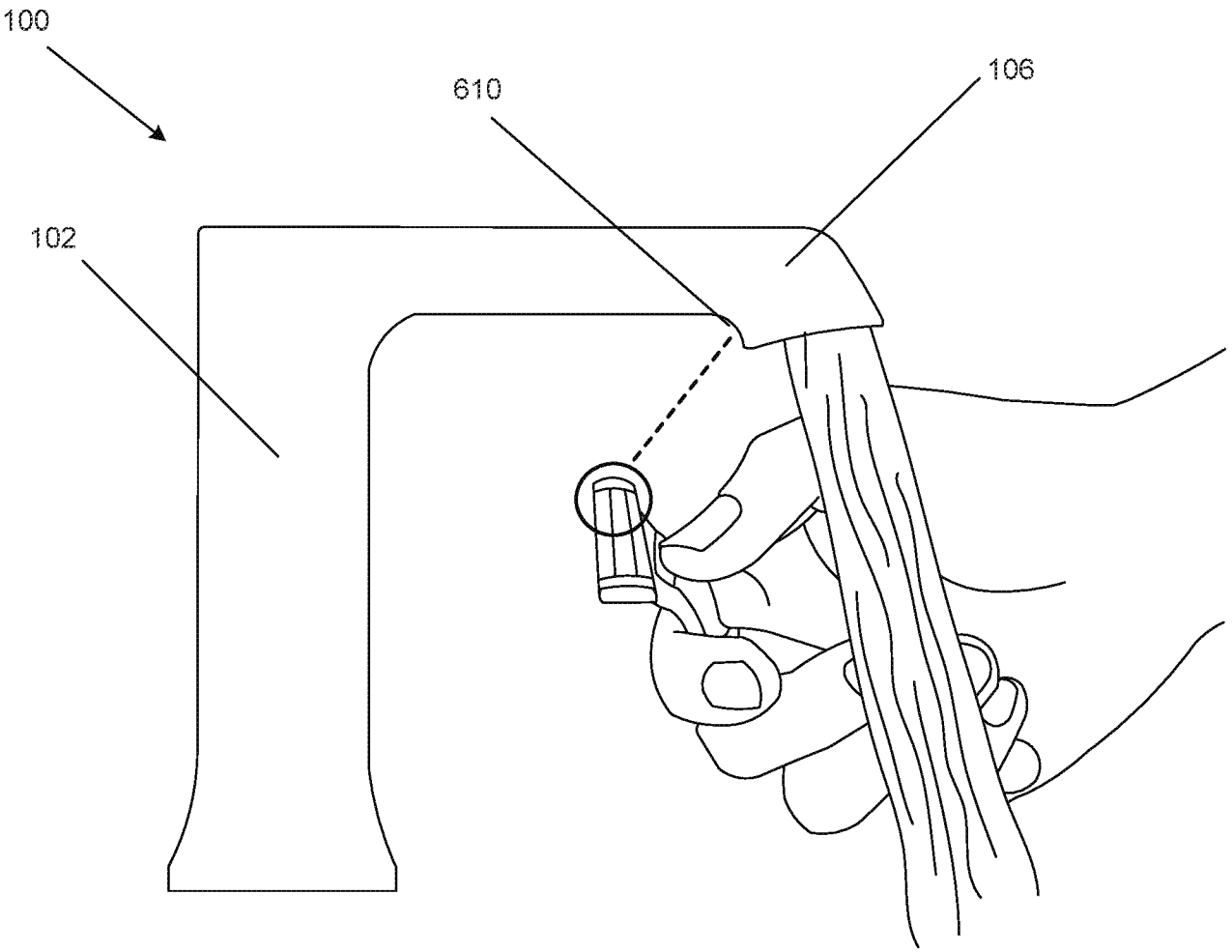
FIG. 6 illustrates a perspective view of an example faucet according to another embodiment of the disclosure.

FIG. 6 illustrates an alternative embodiment of the faucet 100 including a sensor that is a camera 610 on the faucet spout 106. The camera 610 is used to detect the presence of an object. When the camera 610 detects an object, a desired spray pattern is dispensed. In a first embodiment, a first spray pattern is a default spray pattern, which is dispensed when no object is detected by the camera 610. When an object is brought into a field of view of the camera 610, a second spray pattern is dispensed. Alternatively, when an object or motion is detected by the camera 610, such as when a user brings their finger into the field of view, a second spray pattern is dispensed. In such an embodiment, the camera 610 does not ultimately distinguish between objects to determine a spray pattern, but a second spray pattern is dispensed when any object or motion is detected.

In an embodiment, the second spray pattern may be dispensed for a predetermined period of time, for example 5 seconds. However, other durations of time are possible. Still further, when an object is brought back into the field of view of the camera 610 (or the camera 610 detects any object or motion), the first flow pattern is dispensed again.

In a further embodiment, a sensor, such as an optical sensor or infrared sensor as described above, may be located where camera 610 is located. Such a sensor 202 would detect the size of an object, a type of material of an object, a temperature of an object, or motion of an object to determine a desired spray pattern.

Figure 7A:
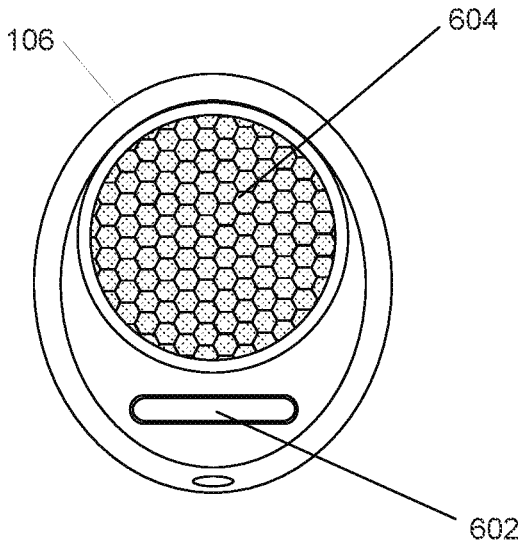
FIGS. 7*a* and 7*b* illustrate an example embodiment of a first outlet and a second outlet.
Figure 7B:
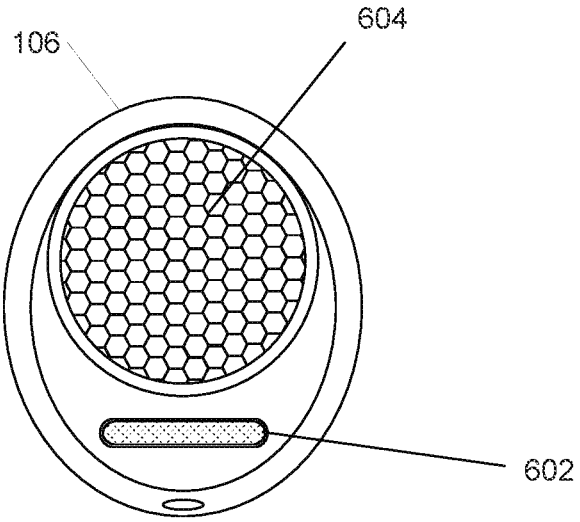

FIGS. 7*a* and 7*b* illustrate an example embodiment of a faucet spout 106 having two outlets. The faucet spout 106 includes a first outlet 602 and a second outlet 604. FIG. 7*a* highlights the first outlet 602 that provides a first spray pattern having a first pressure and a first spray pattern cross-sectional area. The first outlet 602 includes a check valve, which causes water to exit from the first outlet 602 when a pressure within the faucet 100 is above a predetermined threshold.

FIG. 7*b* highlights the second outlet 604 that provides a second spray pattern having a second pressure and a second spray pattern cross-sectional area. The second outlet 604 includes a push seal and an aerator. The push seal is controlled by the spray pattern controller. The aerator diffuses the water stream and provides a softer (lower pressure) water flow pattern.

Figure 8:
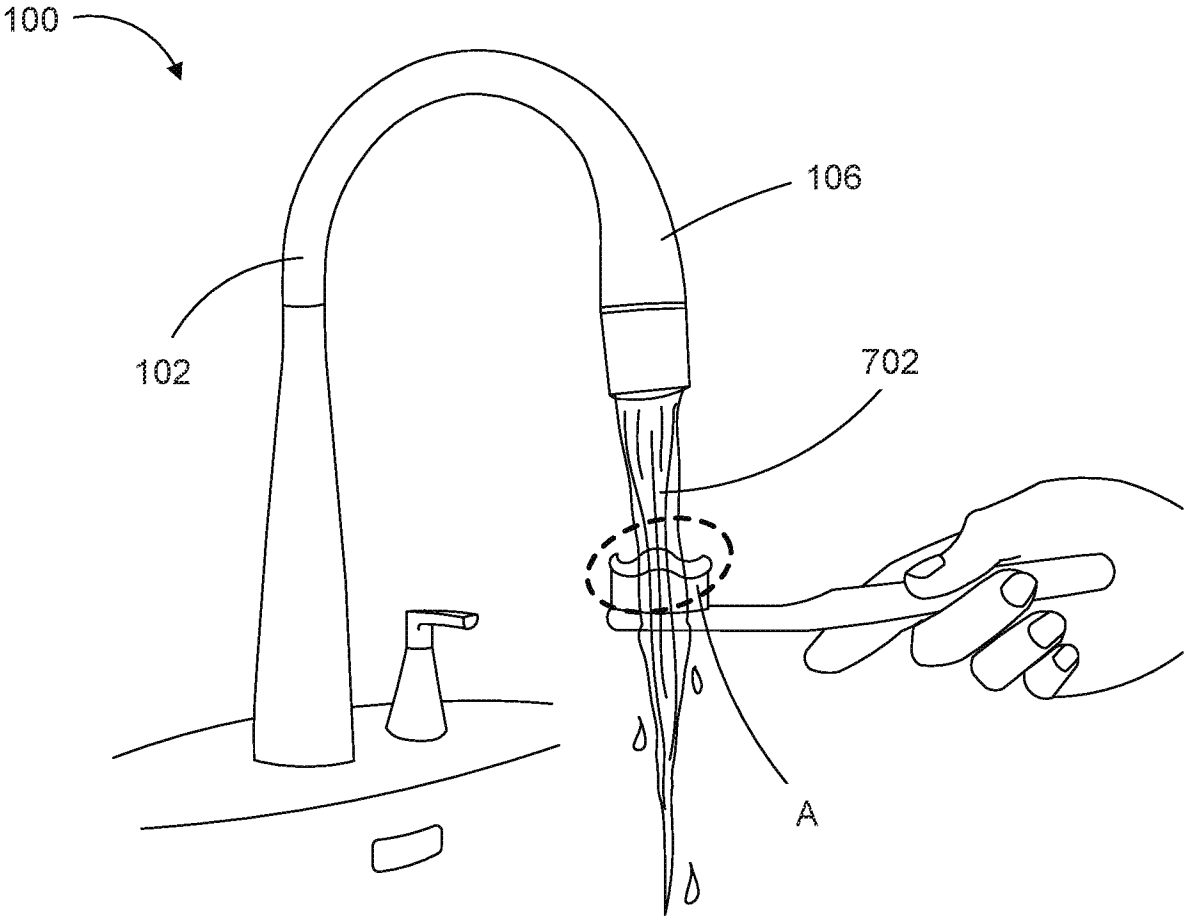
FIG. 8 illustrates an example first spray pattern from the faucet.

FIG. 8 illustrates an example faucet 100 dispersing a first spray pattern 702. As shown, a toothbrush is located proximate the faucet spout 106. In response to detecting a toothbrush, the spray pattern as shown is a high-pressure, narrow flow pattern A.

In an embodiment, the first spray pattern 702 may exit from a first outlet 602 (shown in FIGS. 7*a* & 7*b*) that includes a check valve. When a water pressure within the faucet 100 is above a predetermined threshold, the water exits the check valve. The first outlet 602 provides a first spray pattern 702 having a first pressure and a first flow pattern cross-sectional area. The first spray pattern 702 is different than the second spray pattern. For example, the first outlet 602 may lack an aerator and may be configured to only eject water if water pressure within the faucet 100 is above a predetermined threshold; in such a case, the first spray pattern 702 through the first outlet 602 may be a powerful stream for rinsing everyday objects, such as a toothbrush, razor, or retainer.

In another embodiment, the first spray pattern 702 may exit the faucet spout 106 through a single outlet. In an embodiment having a single outlet, a diverter located within the faucet body 102 directs the flow of water, which determines the spray pattern dispensed. The diverter may toggle between two waterways. A first waterway is associated with a first spray pattern and a second waterway is associated with a second spray pattern.

Figure 9:
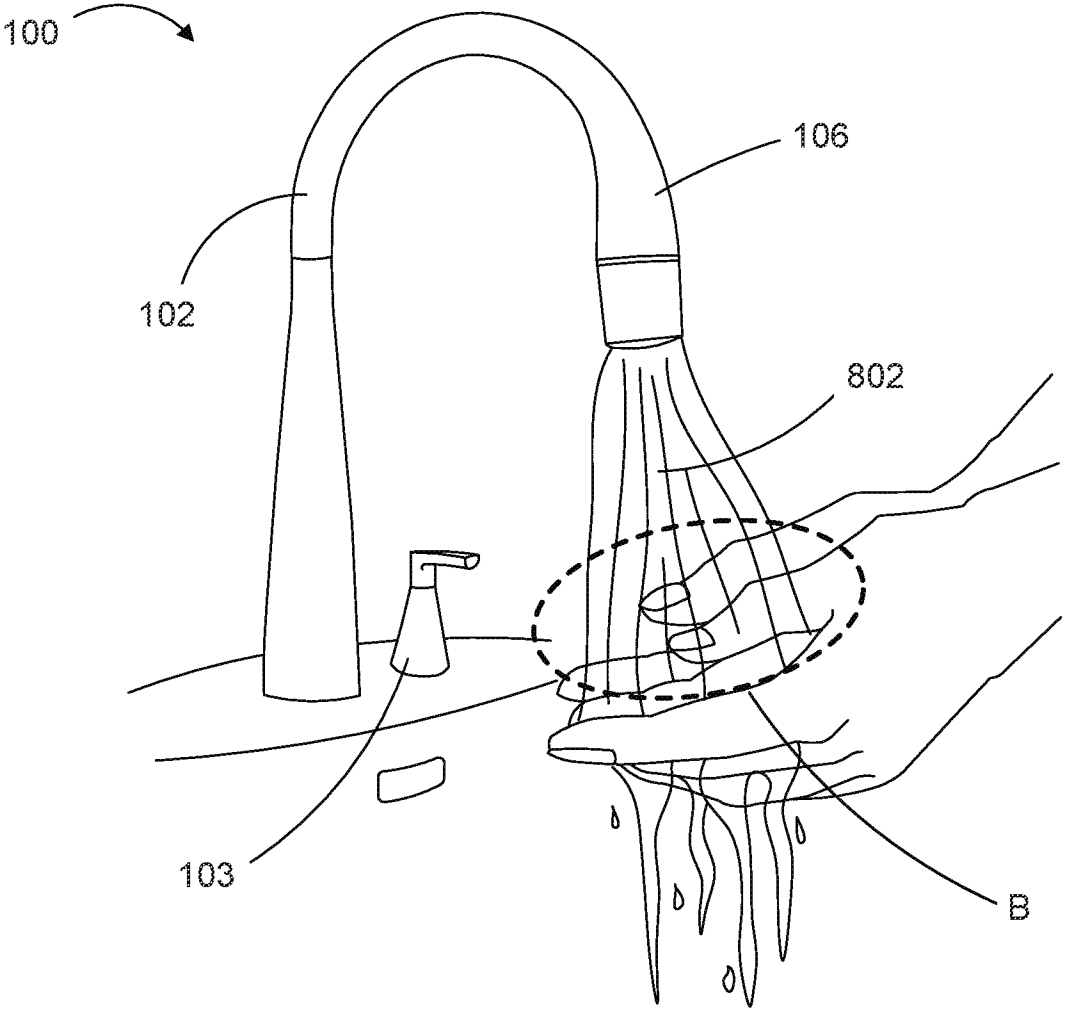
FIG. 9 illustrates an example second spray pattern from the faucet.

FIG. 9 illustrates an example faucet 100 dispersing an example second spray pattern 802. As shown, a user's hands are located proximate the faucet spout 106. In response to detecting a pair of hands, the spray pattern as shown is a second spray pattern 802, which is a low-pressure, wide flow pattern B.

In an embodiment, the second spray pattern 802 may exit from a second outlet 604 (shown in FIGS. 7*a* & 7*b*) that includes a push seal and an aerator. The push seal is controlled by the spray pattern controller. The second outlet 604 provides a second spray pattern 802 having a second pressure and a second flow pattern cross-sectional area. This is due to inclusion of the aerator, which diffuses the water stream and provides a softer (lower pressure) water flow having a generally greater cross-sectional area. A variety of aerator designs may be used to provide different water flow patterns.

As described above, in an alternative embodiment, the second spray pattern 802 may exit the faucet spout 106 through a single outlet. The diverter located within the faucet body 102 directs the flow of water through a second waterway which is associated with the second spray pattern.

In a further embodiment, the spray pattern controller is configured to switch from the first spray pattern 702 to the second spray pattern 802 when an object is detected for a predetermined period of time, and switch back to the first spray pattern 702 after the predetermined period of time has ended. For example, a predetermined period of time is 5 seconds.

Referring to FIGS. 8-9 generally, it can be seen that when water flows through the first outlet 602 (or first water pathway), a water pressure within the faucet 100 will generally be higher than when water flows through the second outlet 604 (or second water pathway). Further, it can be seen that when water flows through the first outlet 602 (or first water pathway), the water cross-sectional area is less than the water cross-sectional area when water flows through the second outlet 604 (or second water pathway).

In another embodiment, the spray pattern controller controls a diverter (not shown) located upstream from the faucet spout 106. The diverter (not shown) receives a first flow of water and directs it based upon the actuation of the spray pattern controller, which is controlled by the controller 108 based on the detection of an object by the sensors 202. The diverter (not shown) controls water in a binary fashion, and is capable of directing water either through a first pathway or a second pathway. In such an arrangement, the first pathway leads water through the faucet spout 106 to dispense a first spray pattern, and the second pathway leads water through the faucet spout 106 to dispense a second spray pattern.

In an alternative embodiment, the first pathway leads water through the first outlet 602, and the second pathway leads water through the second outlet 604. In some embodiments, the push seal discussed above may be eliminated, since such a diverter will be provided by an "upstream" seal that is associated with the spray pattern controller. In still further examples, check valves may be used in both the first outlet 602 and the second outlet 604.

Figure 10:
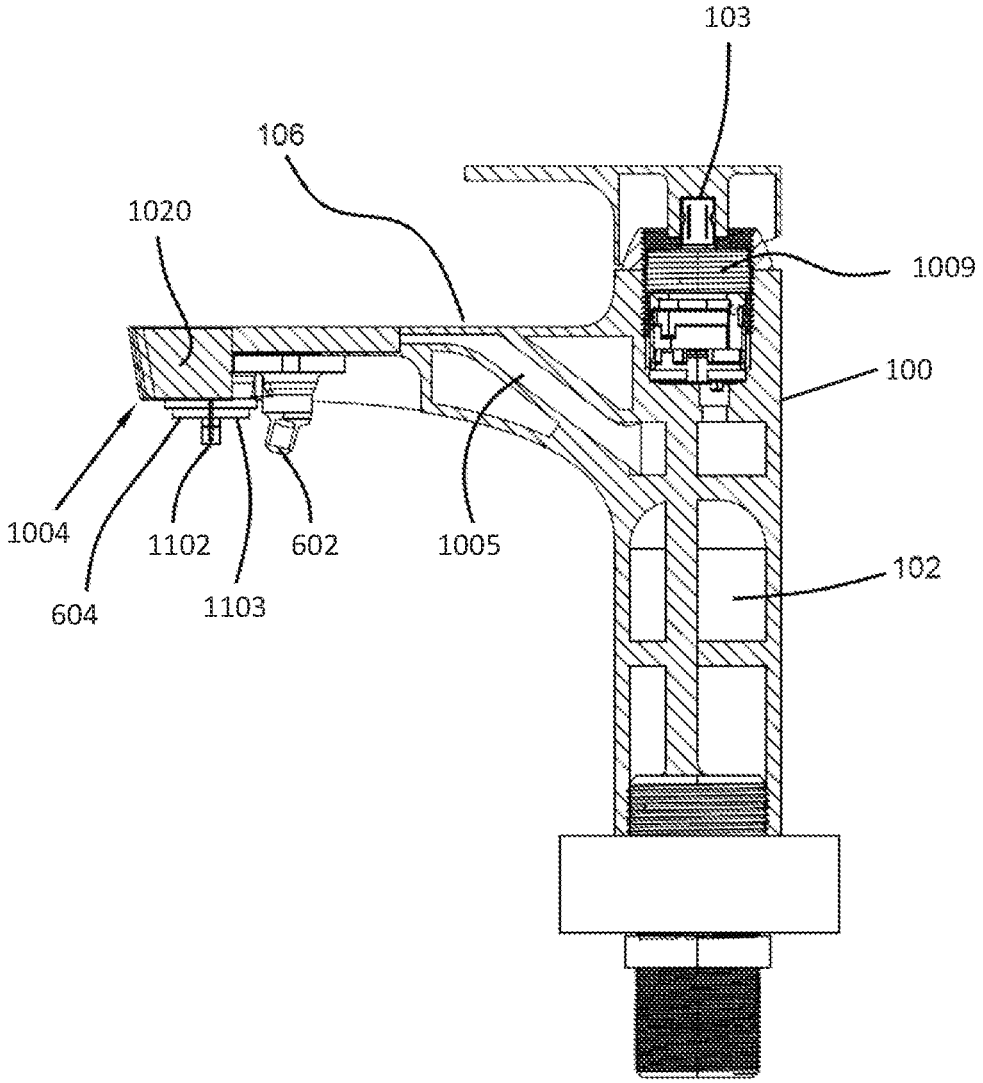
FIG. 10 illustrates a side cross-sectional view of the faucet of FIG. 1.

FIG. 10 illustrates a cross-sectional side view of an example faucet 100. As shown, the handle 103 extends from the faucet body 102, and is interfaced to a cartridge 1009 within the faucet 100 to control the flow of water through a water passageway 1005 in the faucet spout 106 to the outlet portion 1004. As shown, the spray pattern controller 1020 is located at an end of the faucet spout 106 to control water flow through either the first outlet 602 or the second outlet 604, both of which are located at the outlet portion 1004 of the faucet spout 106 at a location proximate to the spray pattern controller 1020. In other embodiments, the handle 103 need not be connected to the faucet body 102, and instead is located on a sink deck next to the faucet body 102.

In other embodiments, the first outlet 602 and the second outlet 604 are located at the outlet portion 1004 while the spray pattern controller 1020 is located at a different position along the faucet spout 106. In such an arrangement, the spray pattern controller 1020 may route water flow along two different paths, leading to the first outlet 602 or the second outlet 604. In the example, the second outlet 604 includes an aerator 1103 and a push seal 1102 that are described further below.

Figure 11:
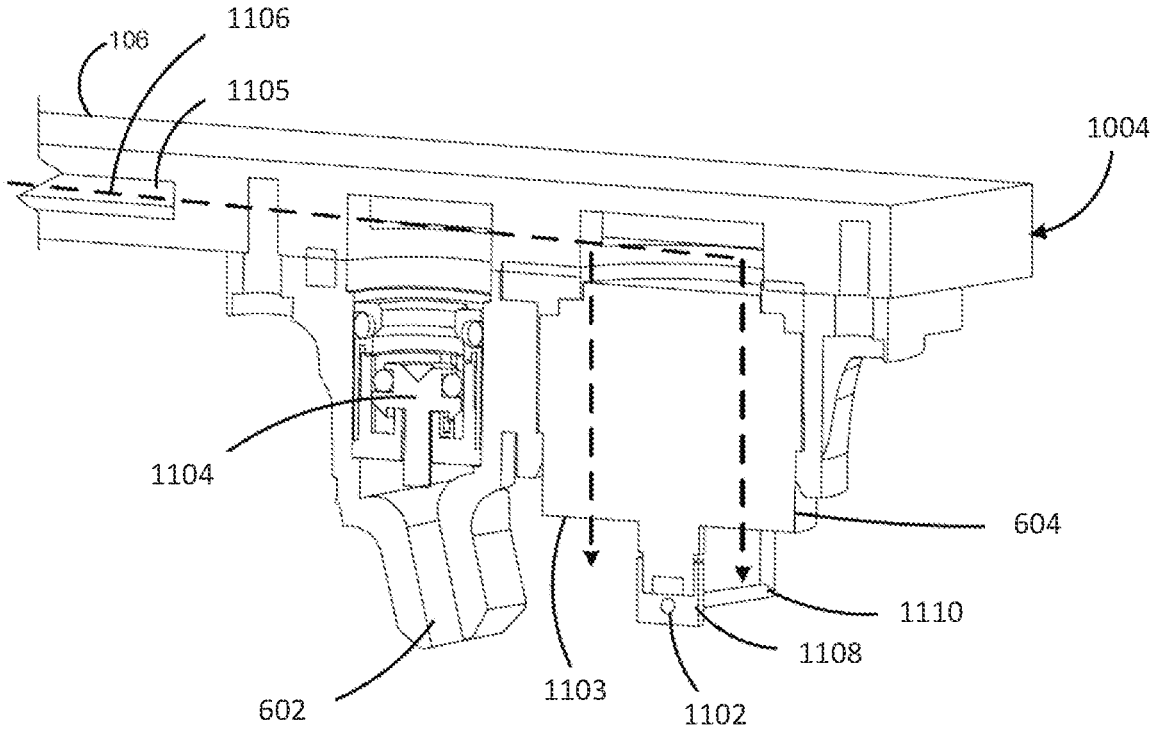
FIG. 11 illustrates a side cross-sectional view of the spray head controller in a first configuration.

FIG. 11 illustrates a further cross-sectional side view of the faucet spout 106 and outlet portion 1004, including the first outlet 602 and second outlet 604. As shown, water follows a first water flow pathway 1106 (e.g., leading through water passageway 1105) where the water exits the outlet portion 1004 through the second outlet 604 when the push seal 1102 is in an open position, thereby allowing water to pass through the aerator 1103. In a first embodiment, the first water flow pathway 1106 is the default water flow pathway. The water may flow through the default pathway when the spray pattern controller 1020 is not actuated. However, in alternative embodiments, the first water flow pathway 1106 is the pathway the water flow takes with the spray pattern controller 1020 is actuated.

In the embodiment shown, the push seal 1102 may be positioned in an open position when the spray pattern controller 1020 is not actuated or toggled, thereby allowing water to flow through the aerator 1103 at the second outlet 604. As further explained below, a check valve 1104 within the second outlet 604 prevents water from concurrently flowing through the first outlet 602. This allows water to flow past the aerator 1103 and into the push seal 1102 though the outlet portion 1004.

The push seal 1102 includes an end portion 1108 that is controlled by the spray pattern controller 1020 via a linker 1110. When the spray pattern controller 1020 is not actuated, the linker 1110 does not provide any pressure to the end portion 1108 of the push seal 1102, thereby allowing water to flow through the aerator 1103.

When the spray pattern controller 1020 is actuated, the linker 1110 provides pressure or otherwise closes the end portion 1112 (shown in FIG. 12) of the push seal 1102 so that water is not capable of flowing through the aerator 1103. This causes water to back up within the body of the outlet portion 1004, and eventually exits the first outlet 602, as described in more detail below.

Figure 12:
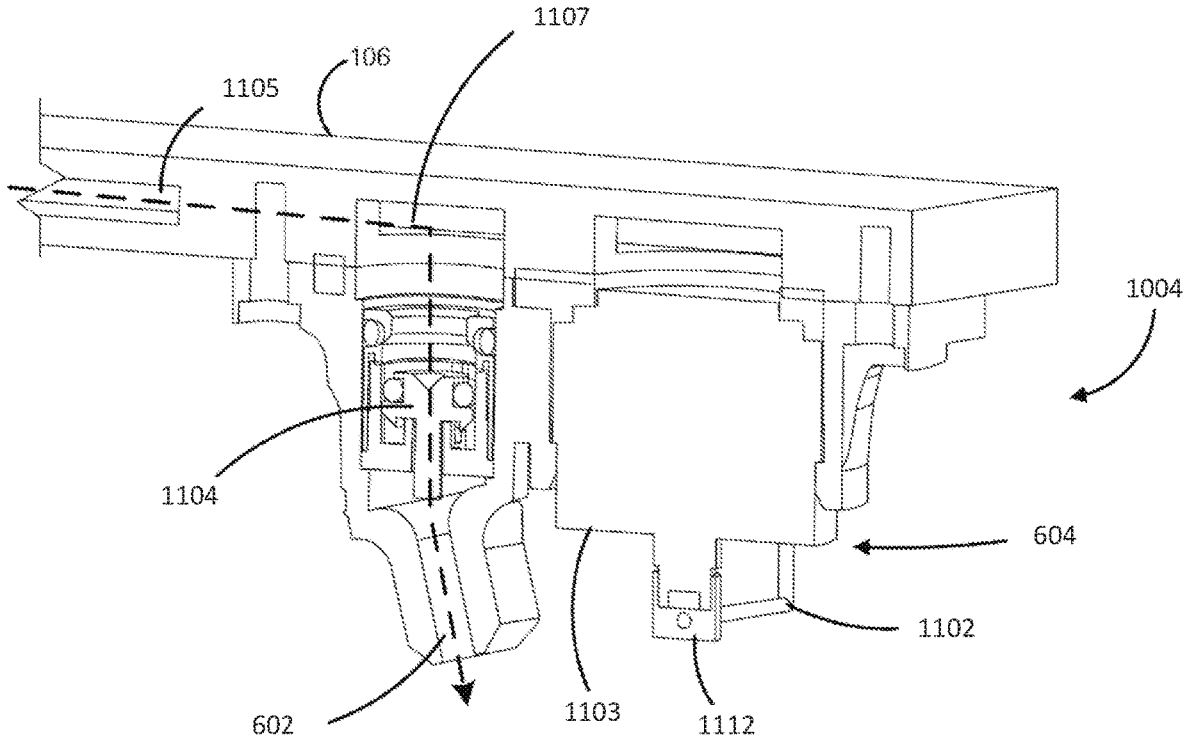
FIG. 12 illustrates a side cross-sectional view of the spray head controller in a second configuration.

FIG. 12 illustrates a cross-sectional side view of the faucet spout 106, the outlet portion 1004, and the first and second outlets 602, 604. In the embodiment shown, water flows through a second pathway 1107 (e.g., through water passageway 1105), which is through the first outlet 602. As described above, when the spray pattern controller 1020 is actuated, the end portion 1112 of the push seal 1102 is closed, which causes a backup of water and pressure within the outlet portion 1004 (e.g., within water passageway 1105). When enough back pressure is built up, a check valve 1104 is opened, allowing water to flow through the first outlet 602.

Referring to FIGS. 11-12 generally, it can be seen that when water flows through the second outlet 604, a water pressure within passageway 1105 will generally be lower than an actuating pressure of the check valve 1104. As such, water may flow along the first water flow pathway 1106, as seen in FIG. 11, without water flowing through the first outlet 602. However, upon actuation of the push seal 1102 (e.g., by the spray pattern controller 1020), pressure within the passageway 1105 will increase since water is prevented from flowing through the aerator 1103, until sufficient pressure has built within the passageway that the check valve 1104 opens, allowing water to pass through the first outlet 602. Notably, because the first outlet 602 has a relatively small aperture, a water pressure is maintained within the passageway 1005, and therefore check valve 1104 remains open, allowing a high-pressure, focused water spray pattern to be ejected from the first outlet 602.

Figure 13:
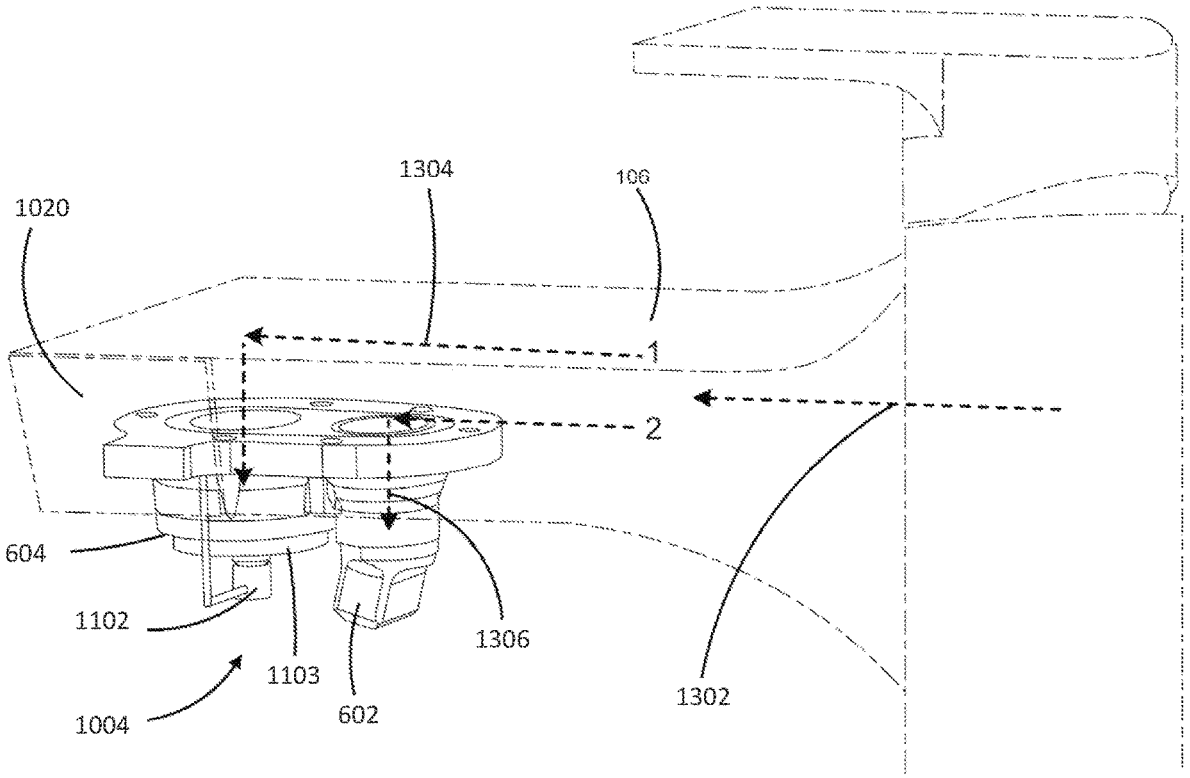
FIG. 13 illustrates a side cross-sectional view of an alternative embodiment of a spray head controller.

FIG. 13 illustrates an alternative embodiment of a faucet spout 106. In the embodiment as shown, a spray pattern controller 1020 is located along a side of the faucet spout 106. In the embodiment shown, the spray pattern controller 1020 controls a diverter (not shown) located upstream from the first outlet 602 and second outlet 604. The diverter (not shown) receives a first flow of water 1302 and directs it based upon the actuation of spray pattern controller 1020. The diverter (not shown) controls water in a binary fashion, and is capable of directing water either through the first pathway 1304 or the second pathway 1306. In such an arrangement, the first pathway 1304 leads water through the second outlet 604, and the second pathway 1306 leads water through the first outlet 602. Notably, in some embodiments, the push seal 1102 may be eliminated, since such a diverter will be provided by the "upstream" seal that is associated with the spray pattern controller 1020. In still further examples, check valves may be used in both the first outlet 602 and the second outlet 604.

Figure 14:
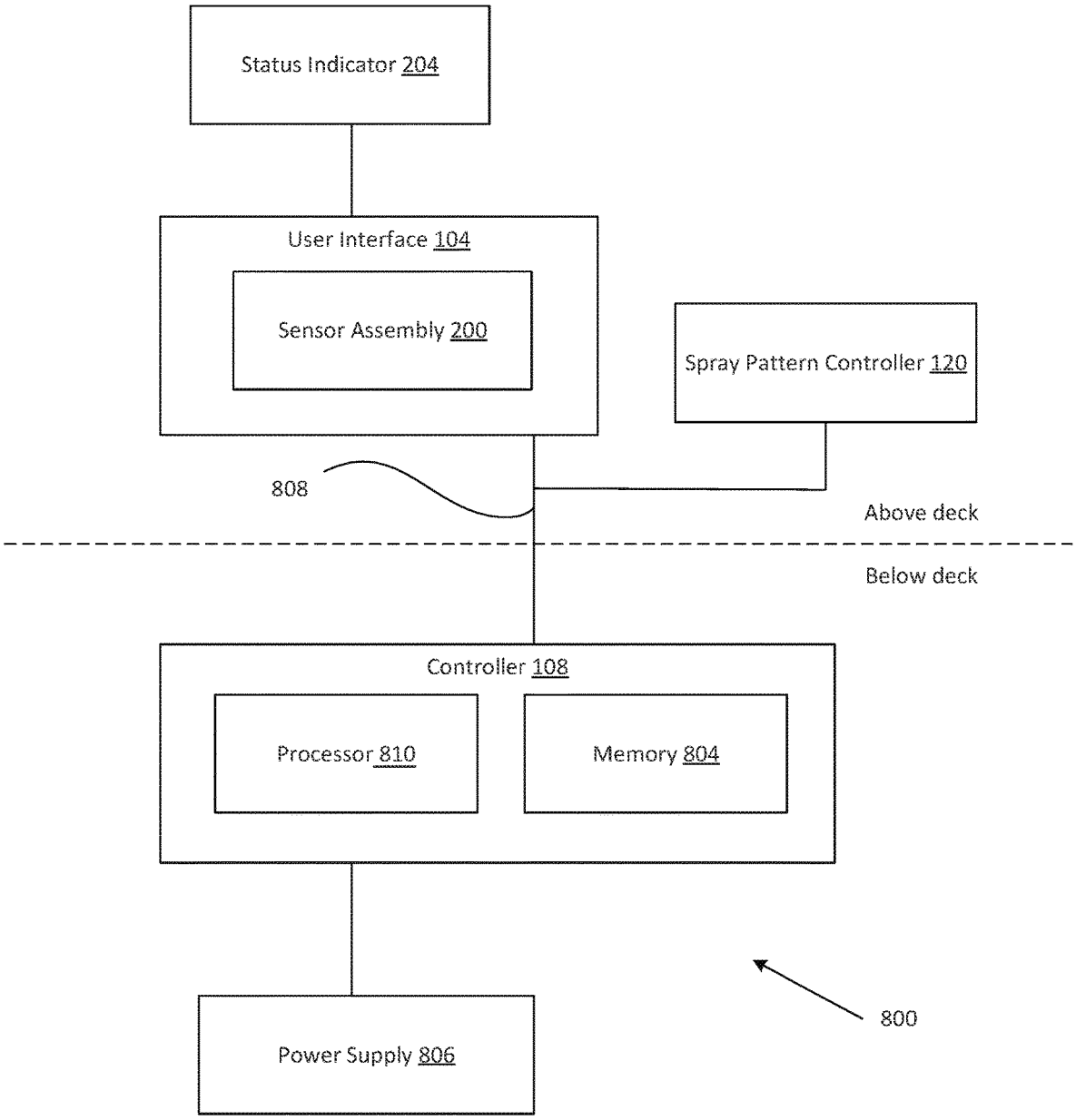
FIG. 14 illustrates a simplified block diagram of an example control system.

Referring to FIG. 14, there is shown an example electronic control system 800 for controlling the spray pattern of water from the faucet 100. In the example shown, the control system 800 includes the controller 108 including a processor 810 to process the signals received from the sensor assembly 200 to send a signal to the spray pattern controller 120 and a memory 804 to store instructions to be executed by the processor 810. The controller 108 may also be connected to circuitry 808. The control system 800 also includes a power supply 806 that is connected to the controller 108 and the spray pattern controller 120.

The spray pattern controller 120 is configured to control the spray pattern dispensed from the faucet spout 106 based upon an input received by the sensor assembly 200. In an embodiment, the spray pattern controller 120 may be located within the faucet spout 106 and controlled by the controller 108. However, in another embodiments, the spray pattern controller 120 may be located elsewhere, such as below a sink deck.

In one embodiment, the user interface 104 including the sensor assembly 200, the status indicator 204, and the spray pattern controller 120 are located above the countertop, and the controller 108, and power supply 806 are located below the countertop. The components of the control system 800 may be arranged above and below the countertop as appropriate. The power supply 806 provides power to the sensor assembly 200 through the controller 108. In another embodiment, the power supply 806 may be connected directly to the sensor assembly 200, and the spray pattern controller 120. The power supply 806 can be power supplied from an outlet and converted as necessary for use by the controller 108, and sensor assembly 200. The spray pattern controller 120 may have a separate power supply 806 than the controller 108. The power supply 806 may be any power source to supply electrical power for the function of the sensor assembly 200, controller 108, and the spray pattern controller 120.

The sensor assembly 200 can send the object size, object material, object motion, or object temperature received from the sensors 202 to the controller 108 to use an algorithm in order to determine a desired spray pattern. For example, if a toothbrush is detected, a high pressure and small area flow pattern is used. In another embodiment, the controller 108 may use a look-up table to determine the desired spray pattern, for example, a user may program the faucet 100 to produce a desired spray pattern when a specific object is detected. The controller 108 sends a signal to the spray pattern controller 120, which adjusts the spray pattern as needed.

In another embodiment, machine learning is used to train the control system 800 to detect an object and dispense a desired spray pattern.

In another embodiment, the faucet circuitry 808 may include networking components (e.g., Bluetooth, WiFi, mesh networking, Zigbee, etc.) such that the faucet 100 is communicatively coupled with the controller 108. In some embodiments, the faucet 100 may use one or more communication links that allows the faucet 100 to be located a distance from the control system 800.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

The description and illustration of one or more embodiments provided in this application are not intended to limit or restrict the scope of the invention as claimed in any way. The embodiments, examples, and details provided in this application are considered sufficient to convey possession and enable others to make and use the best mode of the claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed invention and the general inventive concept embodied in this application that do not depart from the broader scope.

The invention claimed is:

1. A faucet comprising:

a faucet body comprising a faucet spout having an outlet portion, wherein the outlet portion includes a first outlet and a second outlet, the first outlet different than the second outlet, wherein the first outlet includes a check valve and the second outlet includes a push seal, and wherein the outlet portion defines a flow pathway, the first outlet and the second outlet in flow communication with the flow pathway;

a sensor assembly configured to detect an object within a space proximate the faucet spout, wherein the sensor assembly includes at least two optical sensors housed within a housing;

a spray pattern controller operationally coupled to the push seal and configured to automatically adjust a spray pattern selected from a plurality of spray patterns being dispensed through the faucet spout, wherein when the push seal is closed water flows through the first outlet once pressure proximate the check valve is above a predetermined threshold and when the push seal is open water flows through the second outlet, wherein the plurality of spray patterns includes a first spray pattern defined by the first outlet and a different second spray pattern defined by the second outlet, the first spray pattern having a first flow pattern cross-sectional area and the second spray pattern having a second flow pattern cross-sectional area that is greater than the first flow pattern cross-sectional area; and a controller electronically coupled to the sensor assembly and the spray pattern controller, the controller configured to receive a signal from the sensor assembly and capable of determining a desired spray pattern selected from the plurality of spray patterns based on (1) classifying a size of the object as among a plurality of sizes including at least a first size and a second size, the second size being larger than the first size, and (2) actuating the spray pattern controller to select one of (a) the first outlet and the first flow pattern cross-sectional area in response to classifying the object as being the first size or (b) the second outlet and the second flow pattern cross-sectional area in response to classifying the object as being of the second size.

2. The faucet of claim 1, wherein the sensor assembly is further configured to detect one of a type of material of the object and a motion of the object.

3. The faucet of claim 1, wherein the sensor assembly further comprises at least one infrared sensor configured to detect a temperature of the object in proximity to the faucet spout.

4. The faucet of claim 1, wherein the spray pattern controller is located within the faucet spout and comprises a diverter.

5. The faucet of claim 1, wherein the spray pattern controller is located below a sink deck and comprises a mechanism to select between a plurality of waterways.

6. The faucet of claim 1, wherein the first spray pattern has a first pressure and the second spray pattern has a second pressure lower than the first pressure.

7. The faucet of claim 1, wherein the faucet further includes a handle that manually controls a flow of water through the faucet spout based on user-actuated movement of the handle.

8. The faucet of claim 1, wherein the sensor assembly is integrated with the faucet body.

9. The faucet of claim 1, wherein the sensor assembly is located on a faucet deck.

10. The faucet of claim 1, wherein the controller is further configured to control the spray pattern controller based on one of a type of material of the object and a motion of the object.

11. The faucet of claim 1, wherein the controller is further configured to dynamically adjust the spray pattern controller based on a change in the object sensed by the sensor assembly.

12. The faucet of claim 1, further comprising a computing system having a machine learning algorithm configured to detect one or more objects and determine the desired spray pattern based on a detected object.

13. A method of controlling a spray pattern dispensed from a faucet, the method comprising:

detecting, via a sensor assembly comprising at least two optical sensors, an object located in a space proximate to a faucet spout;

determining, via the at least two optical sensors in combination, a size classification of the object, wherein the size classification includes at least a large object and a small object;

sending a signal from the sensor assembly to a controller, the controller electronically coupled to the sensor assembly and a spray pattern controller, wherein the controller is configured to determine a desired spray pattern selected from a plurality of spray patterns based at least partially on the determined size classification of the object such that a size of the object is correlated to a flow pattern cross-sectional area;

sending a second signal from the controller to the spray pattern controller; and adjusting the spray pattern through the faucet spout, the spray pattern controlled by the spray pattern controller, wherein the faucet spout has an outlet portion that includes a first outlet and a second outlet, the first outlet defining a first spray pattern having a first flow pattern cross-sectional area different than the second outlet defining a second flow pattern having a second flow pattern cross-sectional area that is greater that the first flow pattern cross-sectional area, wherein the first outlet includes a check valve and the second outlet includes a push seal, and wherein the outlet portion defines a flow pathway, the first outlet and the second outlet in flow communication with the flow pathway, and wherein adjusting the spray pattern includes opening or closing the push seal such that when the push seal is closed water flows through the first outlet with the first flow pattern cross-sectional area and for the small object size classification and when the push seal is open water flows through the second outlet with the second flow pattern cross-sectional area and for the large object size classification.

14. The method of claim 13, wherein the sensor assembly is further configured to detect one of a type of material of the object and a motion of the object.

15. The method of claim 13, wherein the sensor assembly further comprises at least one infrared sensor configured to detect a temperature of the object in proximity to the faucet spout.

16. The method of claim 13, wherein the first spray pattern has a first pressure and the second spray pattern has a second pressure lower than the first pressure.

17. The method of claim 16, wherein the spray pattern controller is configured to switch to the second spray pattern for a predetermined period of time and switch back to the first spray pattern after the predetermined period of time has ended.

18. The method of claim 13, wherein the spray pattern is adjusted without requiring manual adjustment of the faucet.

19. The method of claim 13, further comprising detecting, via a computing system having a machine learning algorithm, one or more objects and determining the desired spray pattern based on a detected object.

20. An electronic spray pattern control device comprising:

an electronic spray pattern control assembly comprising a fluid inlet and a fluid outlet, and configured to control a water spray pattern being dispensed through a faucet spout, wherein the fluid outlet includes a first outlet and a second outlet, the first outlet defining a first spray pattern having a first flow pattern cross-sectional area different than the second outlet defining a second flow pattern having a second flow pattern cross-sectional area that is greater that the first flow pattern cross-sectional area, wherein the first outlet includes a check valve and the second outlet includes a push seal;

a sensor assembly configured to detect an object within a space proximate the faucet spout, wherein the sensor assembly includes at least two optical sensors housed within a housing; and a controller electronically coupled to the sensor assembly and the electronic spray pattern control assembly, the controller configured to receive a signal from the sensor assembly and capable of adjusting the water spray pattern based on (1) classifying a size of the object as among a plurality of sizes including at least a first size and a second size, the second size being larger than the first size, and (2) actuating the electronic spray pattern control assembly to select one of (a) the first outlet and the first flow pattern cross-sectional area in response to classifying the object as being the first size or (b) the second outlet and the second flow pattern cross-sectional area in response to classifying the object as being of the second size, wherein the adjustment of the water spray pattern is based on when the push seal is closed water flows through the first outlet once pressure proximate the check valve is above a predetermined threshold and when the push seal is open water flows through the second outlet.

21. The electronic spray pattern control device of claim 20, wherein the sensor assembly is further configured to detect one of a type of material of the object and a motion of the object.

22. The electronic spray pattern control device of claim 20, wherein the sensor assembly further comprises at least one infrared sensor configured to detect a temperature of the object in proximity to the faucet spout.

23. The electronic spray pattern control device of claim 20, wherein the sensor assembly is located on a faucet deck.

24. The electronic spray pattern control device of claim 20, further comprising a computing system having a machine learning algorithm electronically coupled to the controller, and configured to detect one or more objects and determine a desired spray pattern based on a detected object.

* * * * *